US005145142A

United States Patent [19]

Szoke

[11] Patent Number: 5,145,142

[45] Date of Patent: Sep. 8, 1992

[54] READER'S BOARD

[76] Inventor: Bela B. Szoke, 409 - 1564 SW. Marine Drive, Vancouver, B.C., Canada, V6P 6A6

[21] Appl. No.: 717,243

[22] Filed: Jun. 6, 1991

[51] Int. Cl.[5] ..... A47G 1/24

[52] U.S. Cl. ..... 248/455; 248/463

[58] Field of Search ..... 248/441.1, 454, 455, 248/456, 460, 463, 464, 465, 465.1; 434/408

[56] References Cited

U.S. PATENT DOCUMENTS

| | | | |
|---|---|---|---|
| 12,721 | 11/1807 | Englefield | 248/455 |
| 288,664 | 11/1883 | Reed | 434/408 |
| 645,217 | 3/1900 | Roberts | 248/454 |
| 1,457,458 | 6/1923 | Plamondon | 248/455 |
| 1,580,344 | 4/1926 | Stillians | 248/456 |
| 2,054,098 | 9/1936 | Rich | 248/454 X |
| 3,376,009 | 4/1968 | Domino | 248/456 |
| 3,794,284 | 2/1974 | Guenther | 248/441.1 |
| 4,618,119 | 10/1986 | Powell | 248/456 |
| 5,035,393 | 7/1991 | Menaged | 248/456 |

*Primary Examiner*—J. Franklin Foss

[57] ABSTRACT

A tilted board made to hold reading material to study for increasing clarity. It helps to maintain order among papers, especially when more than one reference material needs to be observed. It allows limited writing possibilities like changing or underlining words, making notes etc. When the board's surface is treated with the necessary material, it permits one to write on it by chalk or marking pen.

3 Claims, 1 Drawing Sheet

READER'S BOARD

FIELD OF THE INVENTION

This invention relates to a reader's board to reduce fatigue from continuous study by increasing the clarity of printed material. The board also allows one to write on a tilted surface.

DESCRIPTION OF THE PRIOR ART

In general reading material is placed on a desk, table or other horizontal surfaces to study. As the reader looks at the characters there is an angle of approximately 30 to 60 degrees between the eyes and the horizontal surface. This angle varies continuously as the eyes move to the end of the page. If we assume an angle as an average of 45 degrees, then we can see only 70 percent in height of the characters. Of course, 30 percent reduction in height of characters undoubtedly reduces the clarity of the prints. Consequently, the vague borderlines of the characters will impose strain on the eyes. The strain causes headache, may lead to serious vision problems and possibly to a dislike of reading, because of its harmful effect.

SUMMARY OF THE INVENTION

These disadvantages may be overcome by placing the book or other reading material onto reader's board according to the invention, thereby providing the reader a constant, close to perpendicular viewing of the page and reducing to minimum the angular deviations of the observed characters. It also allows one to write on the book, or sheet of loose paper placed on the board's surface, or on the board itself by chalk, or other erasable marking pen, if the board's surface is treated by the necessary coating material. To be used by adults and children.

In drawings which illustrate embodiments of the invention:

Figure 4:
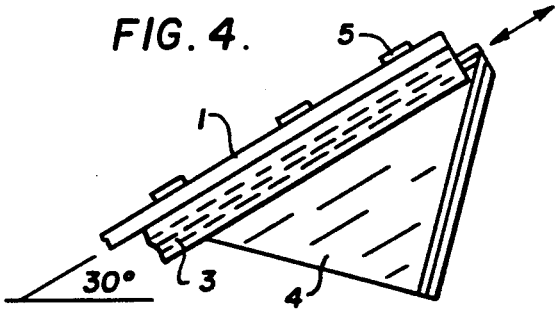
FIG. 4 is a side view of the board of FIG. 1.
Figure 5:
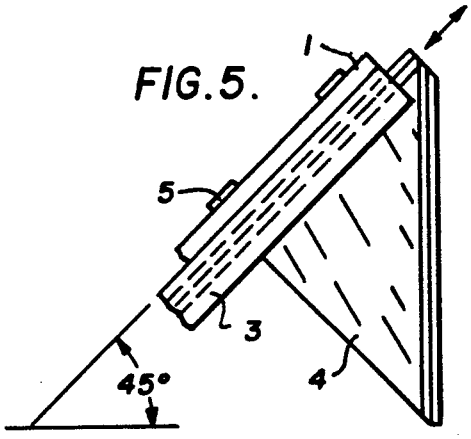
FIG. 5 is a further side view.
Figure 2:
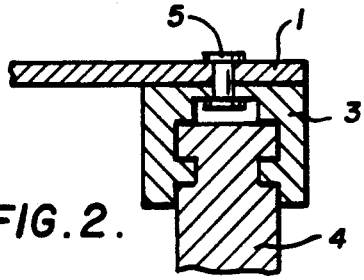
FIG. 2 is a detail of FIG. 1.
Figure 3:
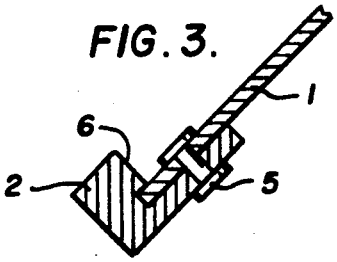
FIG. 3 is a cross-section further detail of FIG. 1.
Figure 1:
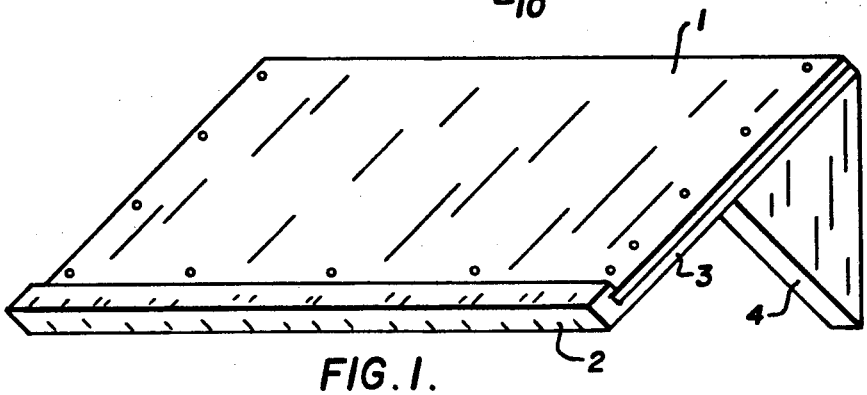
FIG. 1 shows a first embodiment of the invention.

The drawings show a tilted rectangular composite board 1 a rim 2 at its lower, horizontal edge, and a face 6 perpendicular to the board's upper surface, as shown in FIG. 3. The rim may be glued, fastened, molded or extruded if plastic or aluminum is used for construction. If sheet metal or plastic sheet is the material bending is used. The rim 2 holds a book or other material from sliding down the board's tilted surface. At both sides of the board there is a channel 3 attached permanently to it as shown in FIG. 2, by fasteners or rivets 5. Channel 3 slidably receives leg 4 to support the board in stable, tilted position to bear the weight of a book, and hand movements during writing. The board's 30 degree tilt is obtained by sliding the leg's hypotenuse into channel 3 as shown in FIG. 2 and 4. A 45 degree tilt is obtained by sliding the shorter leg's grooves as shown in FIG. 1 and 5. Both settings may be increased or decreased about 10 degrees. The material for construction may be wood, plywood, plastic, composition board, metal or other material alone or in combination.

Figure 7:
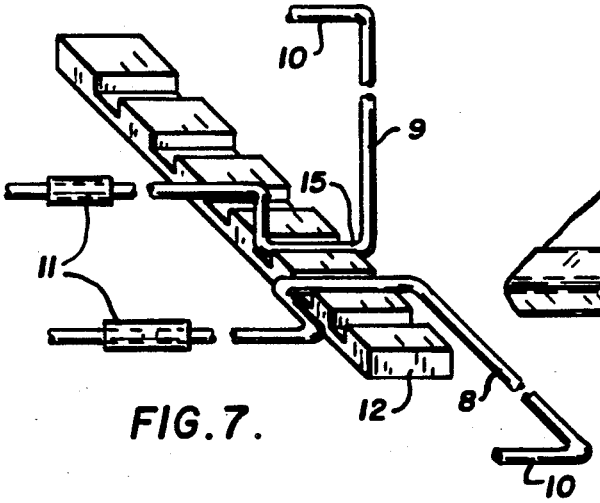
FIG. 7 is a detail of the embodiment of FIG. 6.
Figure 6:
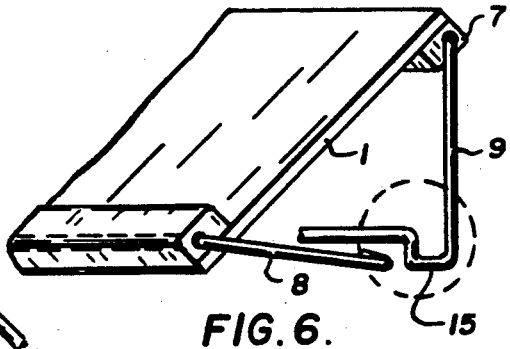
FIG. 6 shows part of a further embodiment of the invention.

FIGS. 6 and 7 illustrate an alternative method of controlling the tilt of the board. In this embodiment, rim 7 has hole or holes to receive a bent portions 10 of rods 8 and 9, one of which is formed with a U portion 15. U portion 15 is received in a serrated block 12 to stabilize the tilt of the board.

The rods 8 and 9 are joined with their symmetrical parts within a sleeve 11 or may be bent from one piece at assembly. The arrangement functions as follows. To obtain a 45° tilt the longer rod 9 is placed in the vertical or close to vertical position as shown in FIG. 6. The 30° tilt is obtained by placing the shorter rod 8 in the rim 7 and reversing the serrated strip 12 to maintain the stable relationship between the rods 8 and 9 while varying the angle of inclination of the board.

I claim:

1. A reading board to increase clarity of printed material and to allow writing on a tilted surface, the board comprising:

(a) a rectangular flat board having a lower edge, a top edge and a main surface;

(b) a rim perpendicular to said main surface to retain reading material on said surface;

(c) a pair of wire legs, one leg pivotally attached adjacent the lower edge of the board and the other pivotally attached adjacent the top edge of the board, the legs of the pair being of different length so that interchange of the legs allows the angle of tilt to be varied; and (d) a serrated strip to receive the legs to stabilize the reading board.

2. A board as claimed in claim 1 in which the board's main surface is treated or coated by a material to accept writing by chalk or other erasable means.

3. A board as claimed in claim 1 in which wood, plastic, metal or other man-made materials are used for construction.

* * * * *